US007126067B2

(12) United States Patent
Culicchia, Jr. et al.

(10) Patent No.: US 7,126,067 B2
(45) Date of Patent: Oct. 24, 2006

(54) SWITCH BLOCKING APPARATUS

(75) Inventors: Carl F. Culicchia, Jr., Mandeville, LA (US); Danny Madjzoob Hoss, Peachtree City, GA (US)

(73) Assignee: Entergy Corporation, New Orleans, LA (US)

( * ) Notice: Subject to any disclaimer, the term of this patent is extended or adjusted under 35 U.S.C. 154(b) by 185 days.

(21) Appl. No.: 10/964,125

(22) Filed: Oct. 13, 2004

(65) Prior Publication Data

US 2006/0076221 A1 Apr. 13, 2006

(51) Int. Cl.
*H01H 9/28* (2006.01)

(52) U.S. Cl. ..... 200/43.16; 200/43.11

(58) Field of Classification Search .. 200/43.01–43.02, 200/43.08, 43.16, 43.18, 43.21, 43.11, 50.01
See application file for complete search history.

(56) References Cited

U.S. PATENT DOCUMENTS

| | | | | |
|---|---|---|---|---|
| 1,069,518 | A | | 8/1913 | Barnett |
| 1,092,259 | A | | 4/1914 | Harn |
| 1,215,837 | A | | 2/1917 | Needham |
| 1,281,127 | A | | 10/1918 | Blankenship |
| 1,298,745 | A | | 4/1919 | Lum |
| 1,327,979 | A | | 1/1920 | Boehmig |
| 1,339,506 | A | | 5/1920 | Getts |
| 1,558,628 | A | | 10/1925 | Purcell |
| 1,774,540 | A | | 9/1930 | Alsaker et al. |
| 3,968,665 | A | | 7/1976 | Kaufmann |
| 4,304,110 | A | | 12/1981 | Fain |
| 4,768,359 | A | | 9/1988 | Wade |
| 4,882,456 | A | | 11/1989 | Hovanic et al. |
| 5,141,119 | A | * | 8/1992 | Milazzo ..... 212/290 |
| 5,207,315 | A | * | 5/1993 | Benda ..... 200/43.11 |
| 5,451,730 | A | | 9/1995 | Phillips, Sr. |
| 5,473,918 | A | | 12/1995 | Hixon |
| 5,570,600 | A | | 11/1996 | Hua |
| 5,593,020 | A | * | 1/1997 | Alexander ..... 200/43.14 |
| 5,794,760 | A | * | 8/1998 | Alexander ..... 200/43.14 |
| 5,823,321 | A | | 10/1998 | Leclerc |
| 5,900,600 | A | * | 5/1999 | Alexander et al. ..... 200/43.14 |
| 6,266,231 | B1 | * | 7/2001 | Donahue et al. ..... 361/631 |
| 6,469,264 | B1 | * | 10/2002 | Benda ..... 200/43.14 |
| 6,541,717 | B1 | | 4/2003 | Roberts |
| 6,727,441 | B1 | * | 4/2004 | Benda ..... 200/43.15 |

* cited by examiner

*Primary Examiner*—Richard K. Lee
(74) *Attorney, Agent, or Firm*—J. Charles Dougherty

(57) ABSTRACT

A device to prevent inadvertent closure of switches. The device includes a horizontal blocking member and in some embodiments an optional vertical blocking member. The device attaches to a rotary element in communication with the switch such as an operating pipe and prevents closure of the switch by striking structural components in the area of the switch as the pipe rotates. The device is of particular application with respect to high-voltage and extra high-voltage switches as typically employed in electrical transmission and distribution substations.

20 Claims, 5 Drawing Sheets

SWITCH BLOCKING APPARATUS

BACKGROUND OF THE INVENTION

The present invention relates to safety mechanisms for blocking the travel of electrical air break switches, and in particular to mechanisms for blocking the travel of large, high-voltage electrical air break switches such as commonly found in electrical power substations.

A number of different mechanisms to prevent the opening or closing of electrical switches are known in the art. Such devices are primarily employed for the purpose of safety to personnel in the area of the switch, or in the area of the equipment that is powered by electricity fed through the switch. It is often the case that an electrical switch is located in a position remote from such equipment, and inadvertent operation of the switch may cause serious injury to persons attempting to repair the equipment that may become suddenly energized. Likewise, inadvertent application of power to equipment that has not been readied to receive current may cause significant damage to the equipment.

A number of safety mechanisms have been developed for standard knife switches, circuit breakers, and other types of switches commonly encountered. Such mechanisms are taught, for example, by U.S. Pat. No. 1,558,628 to Purcell; U.S. Pat. No. 1,281,127 to Blankenship; U.S. Pat. No. 1,298,745 to Lum; U.S. Pat. No. 1,092,259 to Ham; U.S. Pat. No. 1,774,540 to Alsaker et al.; and U.S. Pat. No. 4,882,456 to Hovanic et al. One significant disadvantage of each of these mechanisms is that the apparatus required to lock the switch in the closed or open position must be attached to each switch in a stationary manner. The parts that are required in order to make the switch lock in the closed or open position are not readily transportable from switch to switch. Thus the employment of these mechanisms is expensive where a large number of switches are involved, since a separate lock is needed for each switch, and the cost increases as the size of the switches increase. Such mechanisms would also be difficult, or in some cases impossible, to retrofit to existing switches.

One particular class of switches where safety technology is not well developed is the high-voltage and extra high-voltage air break switches that are typically employed by electric utility companies at power substations. These types of switches open and close through the rotation of an operating pipe. The pipe is often rotated by means of a gear driven motor drive, and the motor is activated by electronic controls. Since the switches are connected to a motor, they cannot be opened or closed without activation of a control signal (either through a nearby panel or remotely). The switches may be inadvertently opened or closed, however, when they are disconnected or de-coupled from their motor drive assemblies for purposes of maintenance. In addition, there are several types of manual switches of this type, including swing-handle switches (which are operated manually by a lever) and gear-operated switches (which are opened and closed using a hand crank mechanism). All of these types of switches are generally located outdoors, and the inventors of the present invention have found that in some cases a gust of wind is sufficient to inadvertently close an air break switch once it is disconnected or de-coupled from its opening/closing drive assembly. Since these switches are used to relay large electrical currents at very high voltages, the inadvertent closing of such a switch when equipment or personnel are not prepared may, for example, cause serious bodily injury or damage to expensive distribution and transmission equipment. Because these systems are part of an automated electrical transmission and distribution grid, an inadvertent switch closing could also cause a cascade of automatic equipment shutdowns, such that a whole power grid or generating plant is affected. The problem is particularly acute with regard to switches at substations associated with nuclear power plants, since the restart of a nuclear power plant following a safety-related emergency shutdown is a time-consuming and expensive process. Such an occurrence may even impact the availability of power across the grid, resulting in blackouts of service.

The art does contain some devices intended to provide safety lock-out for high-voltage lines and devices. U.S. Pat. No. 5,823,321 to Leclerc teaches a remote-controlled locking device to aid persons performing maintenance on high-voltage transmission or distribution lines. The device incorporates a T-shaped piece that fits to the breaker blade, with a key mechanism that operates the latch on the device. Again, a significant disadvantage of this mechanism is that the lock apparatus must be constructed as an integral part of each switch, and in a typical transmission and distribution grid comprising many thousands of high-voltages switches, the cost of retrofitting the entire system to use such devices would make this solution unfeasible.

The art also contains a number of other devices intended for use in connection with the manipulation of high-voltage switches that are not of the air-break variety discussed herein. U.S. Pat. Nos. 6,541,717 and 5,451,730, to Roberts and Phillips, Sr., respectively, teach switch locking mechanisms for hookstick-controlled switches. U.S. Pat. No. 1,339,506 to Getts teaches a locking switch for another type of high-voltage switch. None of these devices are useable with respect to the air break switches commonly used today in power substations.

What is desired is a simple, inexpensive, reliable device to lock (or block open) high-voltage air break switches when the drive assembly used to open and close the switch, whether manual or motor-driven, is disconnected or de-coupled for maintenance. In addition, it would be desirable that such a device be capable of employment with a wide variety of air break switch designs, and be capable of being retrofitted to such air break switches that are currently used in electricity transmission and distribution substations. The device should be portable so that there is no need to install a lock on every switch where locking is desired. Further, it would be desirable to have such a device that can be readily installed and removed by maintenance personnel in a short amount of time, without specialized equipment or tools and without specialized additional training. These desires are achieved, and the limitations of the related art devices are overcome, in the present invention as described below.

BRIEF SUMMARY OF THE INVENTION

The present invention is directed to a switch blocking device intended for use with large switches, such as the air break switches commonly found at electrical distribution and transmission substations. The purpose of the invention is to provide a temporary means of securing the switch mechanism when the drive assembly for the switch, whether motorized or manual, is disconnected or de-coupled for maintenance or other purposes. The device comprises a short generally horizontally extending member that, when the operating pipe attempts to rotate, will strike the structure around the switch and thereby prevent the switch from achieving full rotation. In alternative embodiments, the device may also comprise a generally vertically extending member that allows the device to be mounted such that the vertical member may strike the switch motor operator support, the crank handle support, or other structure as a means of blocking rotation. The employment of a vertical member is desirable where the travel of the horizontal member would not strike any structure surrounding the switch at the proper angle to prevent closure of the switch. In certain embodiments, the vertical support is mounted to the horizontal member to increase its reach and potential for blocking against a structural member. Further in certain embodiments, the vertical support may be mounted at various positions along the length of the horizontal member, thereby increasing the flexibility of the device in order to provide switch blocking capability in a wide variety of switch configurations and substation designs. It should be noted that while the terms "horizontal member" and "vertical member" may be used herein, these terms are intended to comprise any member that extends in a horizontal direction, regardless of its shape or whether it simultaneously extends at an angle to the horizontal or in other directions as well, so long as its extension comprises a horizontal component. Likewise, the term "vertical member" is meant to comprise any member that extends in a vertical direction, regardless of its shape or whether it simultaneously extends at an angle to the vertical or in other directions as well, so long as its extension comprises a vertical component.

Because of its modular design, the invention may be readily fitted to a wide variety of switches by simply clamping it to the operating pipe, which because of the design of the device prevents the rotation of the operating pipe and thereby prevents the switch from closing (or opening). The device may be installed quickly by maintenance personnel using only a wrench of common size in certain embodiments. The device is highly visible once installed, and thereby reduces the likelihood that the device will be accidentally left in place after the drive assembly is reconnected and thereby prevent operation of the switch. Also due to the modular design, the device may be stored in a relatively small space, increasing its portability. Because the device is intended for use with existing air-break switches without modification, and because it takes advantage of the structure commonly found in all substations surrounding such switches and is easily configurable to conform to such structure, it may be employed with respect to almost any air-break switch found at a transmission or distribution substation.

It is therefore an object of the present invention to provide for a device to block the operation of air-break switches when the drive assembly of such a switch is disconnected.

It is a further object of the present invention to provide for a switch blocking device that is highly configurable so that it can be used on a wide variety of switches.

It is also an object of the present invention to provide for a switch blocking device that may be employed without modification to existing switches.

It is also an object of the present invention to provide a switch blocking device that is highly visible when deployed.

It is also an object of the present invention to provide a switch blocking device that may be installed and uninstalled quickly by maintenance personnel without the need for specialized tools.

These and other features, objects and advantages of the present invention will become better understood from a consideration of the following detailed description of the preferred embodiments and appended claims in conjunction with the drawings as described following:

DETAILED DESCRIPTION OF THE INVENTION

Figure 1:
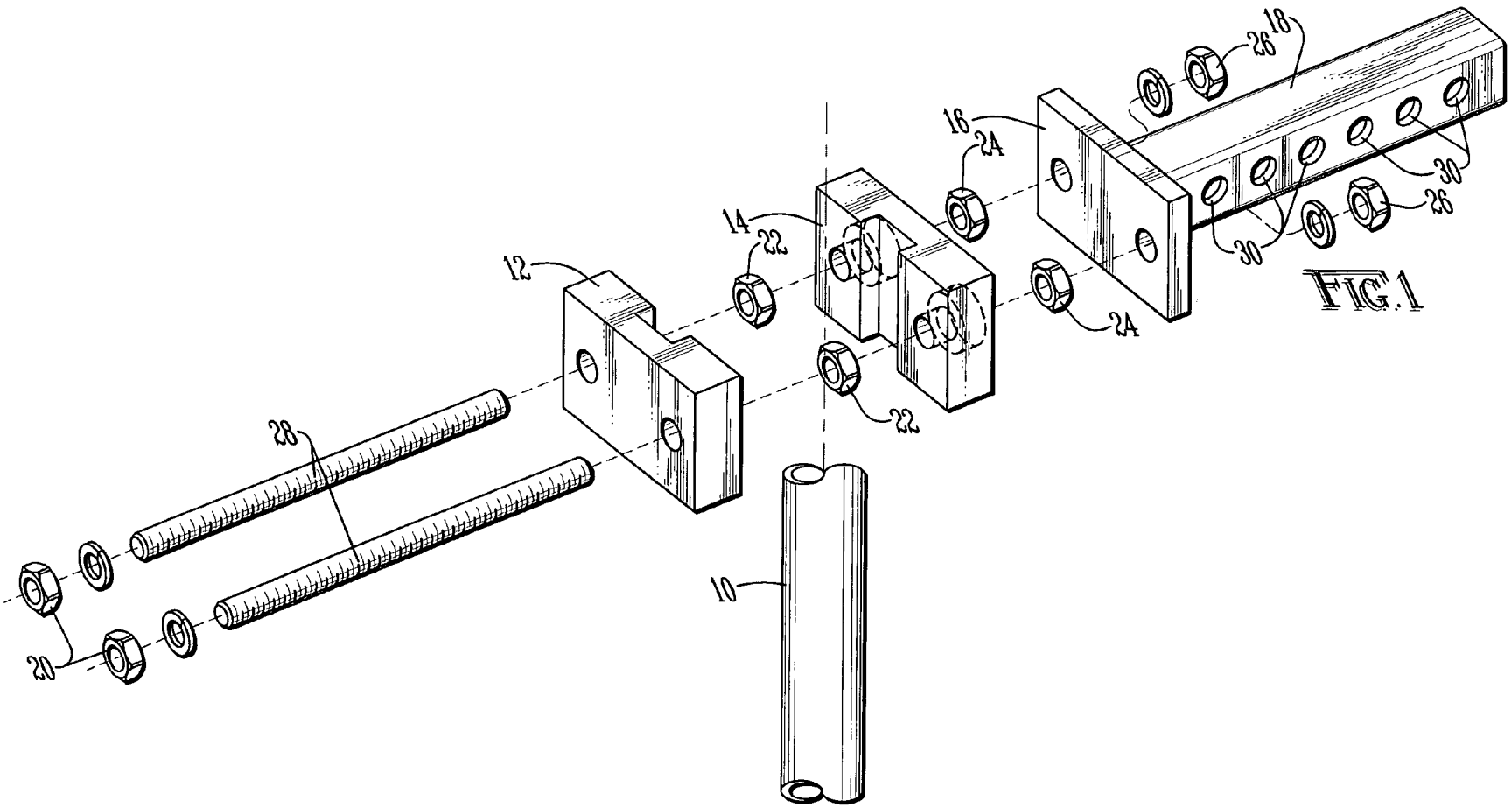
FIG. 1 is a perspective, exploded view of a preferred embodiment of the present invention.
Figure 2:
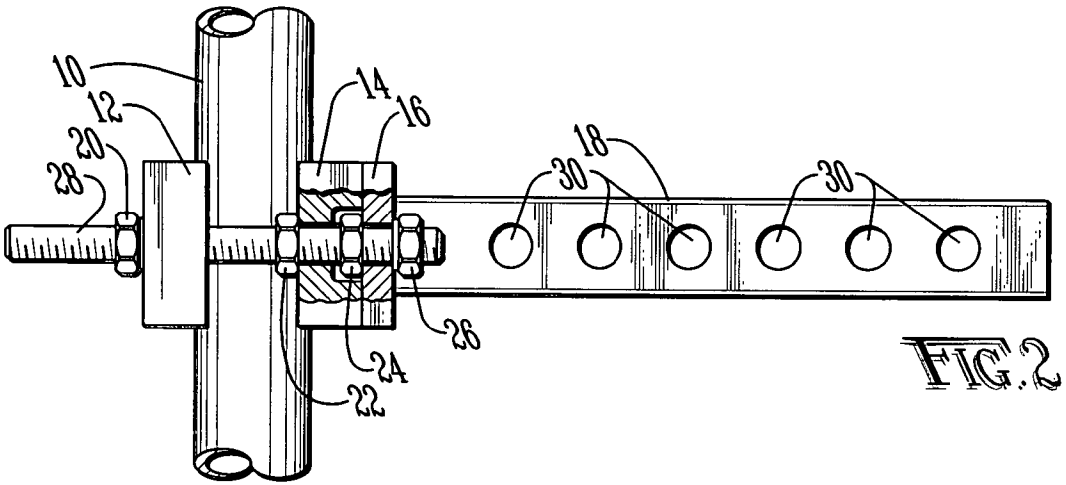
FIG. 2 is a side elevational view, partially in cross-section, of a preferred embodiment of the present invention.
Figure 3:
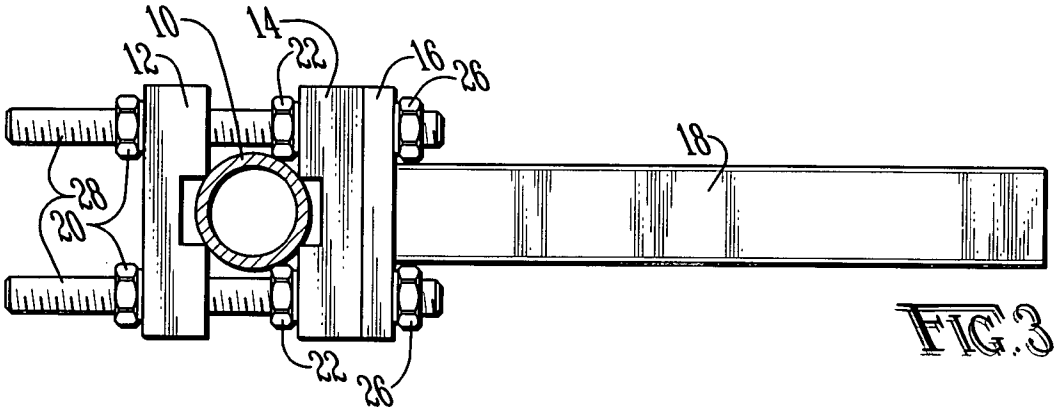
FIG. 3 is a top plan view of a preferred embodiment of the present invention.

With reference to FIGS. 1–3, the preferred embodiment of the present invention may be described used with respect to a motor-driven air-break type switch. Operating pipe 10 (shown in partial cut-away in FIGS. 1–2) is a typical element of a high-voltage substation switch, which rotates as the switch opens and closes due to the activation of a switch motor (not shown). When the switch is disconnected from the motor and motor linkage (not shown), operating pipe 10 may rotate freely. The inventors have found that a significant wind is sufficient to turn operating pipe 10 due to wind resistance on attached rotary components. This rotation may inadvertently close the switch while maintenance is being performed, creating a significant safety hazard.

To prevent inadvertent rotation of operating pipe 10 while the motor and motor linkage are disconnected, the present invention may be connected to operating pipe 10. Front clamping plate 14 and back clamping plate 12 are preferably slotted or curved to fit snugly and securely against operating pipe 10. It has been found that slots in front clamping plate 14 and back clamping plate 12, as shown in FIG. 1, provide a snug fit on a variety of sizes of operating pipe 10. Ideally, the slots or grooves are sized to fit operating pipe 10 diameters in the range of one and one-half to three inches, which encompasses the common operating pipe 10 sizes used in substations throughout the United States.

Front clamping plate 14 and back clamping plate 12 are held together by two threaded bars 28, each of which are fitted orthogonally through front clamping plate 14 and back clamping plate 12, on either side of clamping pipe 10, through holes in front clamping plate 14 and back clamping plate 12 that are sized to receive threaded bars 28. Threaded bars 28 are secured on the outside of back clamping plate 12 with back clamping plate nuts 20. Threaded bars 28 are further secured at the inside of front clamping plate 14 with interior front clamping plate nuts 22. Exterior front clamping plate nuts 24 are threaded onto threaded bars 28 at the outside of front clamping plate 14, and preferably are received within recesses in front clamping plate 14 that are sized to receive exterior front clamping plate nuts 24 such that exterior front clamping plate nuts 24 are fully recessed within front clamping plate 14 and a smooth exterior surface is presented.

Horizontal blocking bar 30 is attached at horizontal blocking bar base 16 to front clamping plate 14. Horizontal blocking bar is preferably constructed of square steel tubing, although numerous other constructions may be employed in alternative embodiments. Horizontal blocking bar 30 preferably extends orthogonally to operating pipe 10 when mounted in position as shown in FIGS. 1–3. Horizontal bar base plate 16 is attached to front clamping plate 14 by threading base plate nuts 26 onto threaded bars 28 extending through holes in horizontal bar base plate 16 sized to receive threaded bars 28. Because exterior front clamping plate nuts 24 are fully recessed within front clamping plate 14 in the preferred embodiment, horizontal bar base plate 16 may sit flush against front clamping plate 14. In a preferred embodiment, the distal end of horizontal blocking bar 18 extends around fourteen inches from the exterior surface of operating pipe 10. Horizontal blocking bar 18 preferably includes a plurality of horizontal bar pin holes 30, the purpose of which is described below. In a preferred embodiment, a total of six such horizontal bar pin holes 30 may be present in horizontal blocking bar 18, evenly spaced on about two and one-eighth inch centers, but many other configurations are possible in alternative embodiments of the present invention.

Figure 4:
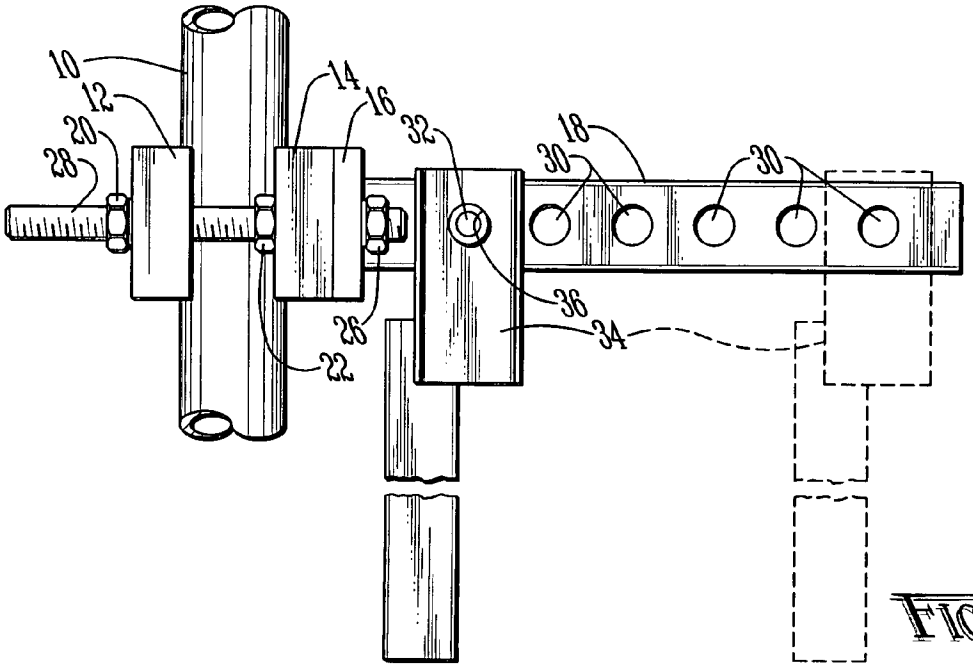
FIG. 4 is a side elevational view of a preferred embodiment of the present invention including a vertical blocking member.
Figure 5:
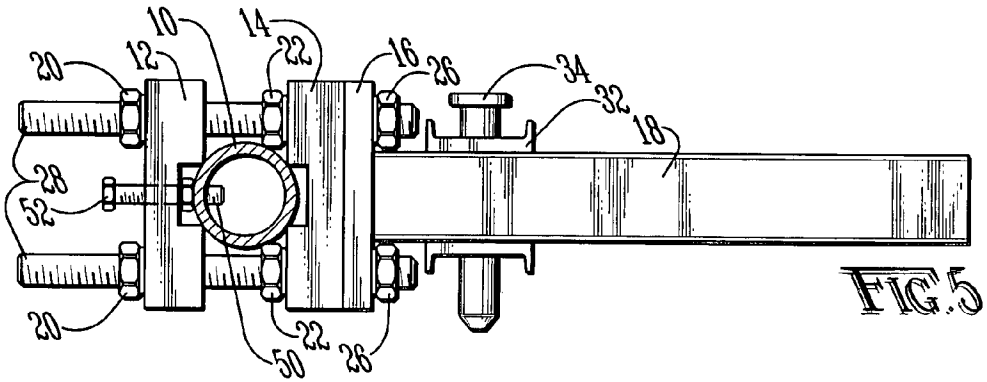
FIG. 5 is a top plan view of a preferred embodiment of the present invention including a vertical blocking member.

With reference to FIGS. 4–5, the optional vertical blocking aspects of the preferred embodiment of the present invention may be described. Vertical blocking bar 34 may be attached to horizontal blocking bar 18 using pin 32. Pin 32 is fitted through one of the horizontal bar pin holes 30 and through vertical block bar pin hole 36 at the proximal end of vertical blocking bar 34. In the preferred embodiment, pin 32 is of a diameter of one inch with a flattened head of greater diameter, and horizontal blocking bar pin holes 30 and vertical blocking bar pin hole 36 are sized to snugly fit pin 32. Once inserted through the proper horizontal blocking bar pin hole 30 and vertical blocking bar pin hole 36, pin 32 may be held in place using a cotter key or other means as are known in the art for securing a pin in a particular position. It should be noted that in alternative embodiments other methods may be used to secure vertical blocking bar 34 to horizontal blocking bar 18 at multiple locations along the length of horizontal blocking bar 18, including without limitation a clamping mechanism. In the preferred embodiment, vertical blocking bar 34 is about twenty-four inches in length, but other lengths may be employed in alternative embodiments.

Also shown in FIG. 5 is optional drill bushing 50 and set screw 52, which may be used with the preferred embodiment of the invention. Drill bushing 50 is mounted through the wall of operating pipe 10 using a drill motor or other comparable device. Drill bushing 50 has internal threads to receive set screw 52. Set screw 52 is threaded into drill bushing 50 and through a hole (not shown) in back clamping plate 12. Set screw 52 thus provides greater security against any rotation of the present device with respect to operating pipe 10.

Figure 6:
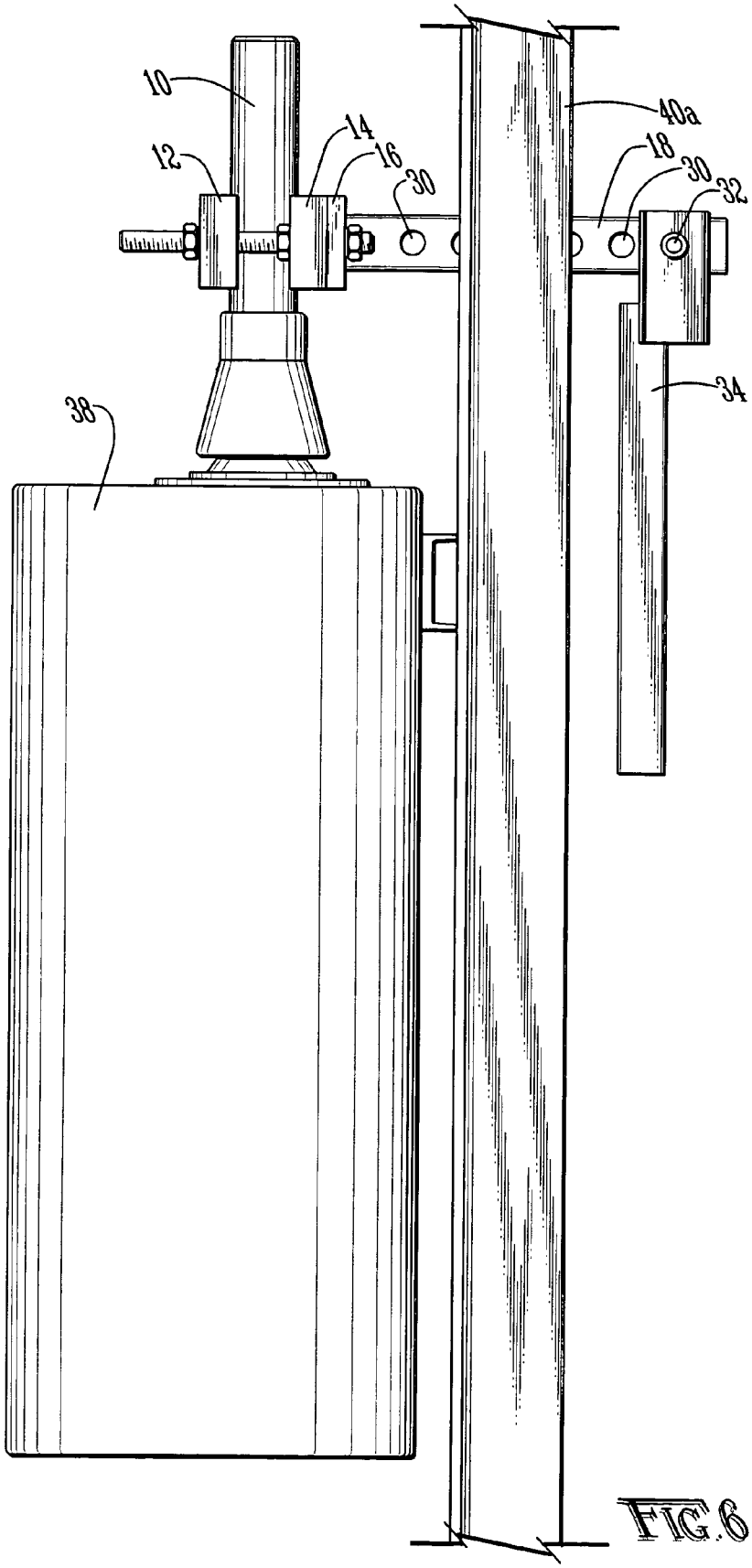
FIG. 6 is a side elevational view of a preferred embodiment of the present invention including a vertical blocking member shown employed with respect to an air-break switch.
Figure 7:
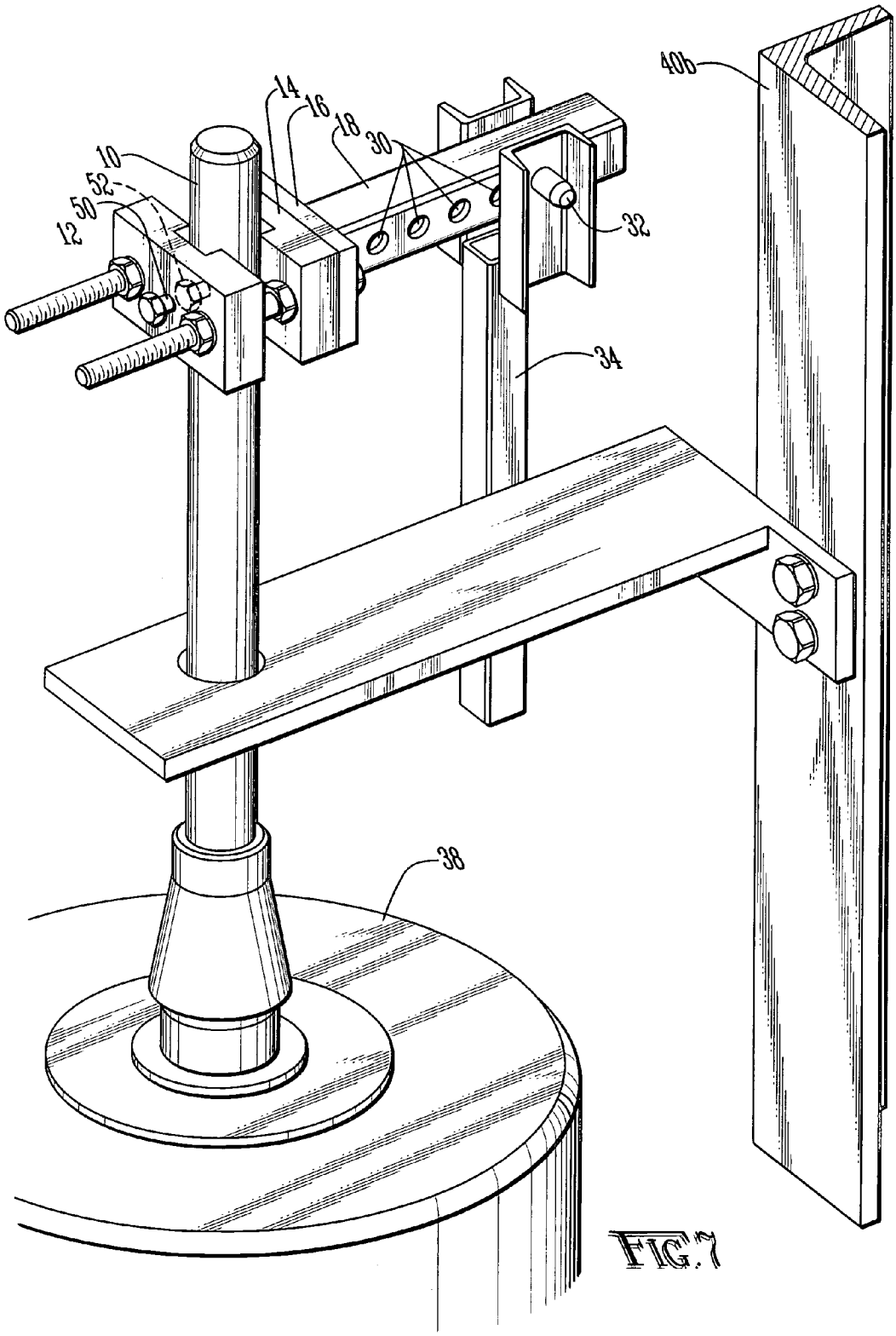
FIG. 7 is a perspective view of a preferred embodiment of the present invention including a vertical blocking member shown employed with respect to an air-break switch in a typical substation environment.

With reference to FIGS. 6 and 7, the operation of a preferred embodiment of the present invention in conjunction with an electrical transmission or distribution substation may be described. In FIG. 6, it may be seen how the present invention may be used to block the closing of a switch using vertical obstacles. Operating pipe 10 is shown with respect to motor assembly 38, from which it may be disconnected for maintenance purposes. As operating pipe 10 rotates, horizontal blocking bar 18 swings in an outward arc, and eventually strikes substation structure 40*a*, thereby blocking further travel of operating pipe 10. This situation prevents closure of the switch associated with operating pipe 10. Likewise, in FIG. 7, it may be seen how the present invention may be used to block the operation of a switch using horizontal obstacles. As shown in FIG. 7, as operating pipe 10 rotates, horizontal blocking bar 18 swings in an outward arc, which further causes vertical blocking bar 34 to swing in a similar arc, eventually striking substation structure 40*b* located below the horizontal plane of horizontal blocking bar 18. This situation again prevents closure of the switch associated with operating pipe 10. In operation, maintenance personnel would analyze the available structure in the area of the operating pipe 10 in a particular substation, and would configure the present invention in an appropriate manner to prevent inadvertent operation of the switch during maintenance. If a vertical obstacle is present at the level of horizontal blocking bar 18, then vertical blocking bar 34 may not be needed; otherwise, vertical blocking bar 34 may be attached to horizontal blocking bar 18 using pin 32 and attached through the appropriate horizontal bar pin hole 30 to allow the device to block the rotation of operating pipe 10 by striking obstacles that are located below (or above) the level of horizontal blocking bar 18. If set screw 52 is to be used in a particular application, drill bushing 50 would be mounted to operating pipe 10 prior to installation of the device, then set screw 52 would be inserted through the receiving hole in back clamping plate 12 and threaded into drill bushing 50.

It should be noted that while it may appear desirable to design horizontal blocking bar 18 and vertical blocking bar 34 to be as long as possible to ensure that they are operable in all possible substation applications, greater length reduces the portability and thus the ease of use of the present invention. The preferred lengths and sizes stated herein reflect the results of design choices made by the inventors hereof based on knowledge of the typical arrangement of electricity transmission and distribution substations, but alternative embodiments might embody any other range of dimensions within the scope of the present invention.

The present invention has been described with reference to certain preferred and alternative embodiments that are intended to be exemplary only and not limiting to the full scope of the present invention as set forth in the appended claims.

What is claimed is:

1. A switch blocking device for attachment to a rotating member adjacent to an obstacle, wherein the switch blocking device is operable to at least partially block axial rotation of such rotating member by striking said obstacle in response to rotation of the rotating member, said blocking device comprising:

(a) a mounting member whereby said blocking device may be securely attached to the rotating member;

(b) a horizontal blocking member attached to said mounting member and extending radially outward from said mounting member wherein rotation of the rotating member causes radial motion of said horizontal blocking member and wherein said horizontal blocking member is stopped from further radial motion at the obstacle.

2. The blocking device of claim 1, further comprising a vertical blocking member attached to said horizontal blocking member and extending outward from said horizontal blocking member, wherein rotation of the rotating member causes radial motion of said vertical blocking member resulting in one of said horizontal blocking member and said vertical blocking member striking the obstacle.

3. The blocking device of claim 2, further comprising means for mounting said vertical blocking member at a plurality of points along said horizontal blocking member.

4. The blocking device of claim 3, further comprising a plurality of horizontal pin holes to receive said pin.

5. The blocking device of claim 4, wherein said horizontal pin holes extend along the length of said horizontal blocking bar.

6. The blocking device of claim 2, further comprising a horizontal pin hole extending horizontally through said horizontal blocking bar, a vertical pin hole extending horizontally through a proximal end of said vertical blocking bar, and a pin passing through said horizontal pin hole and said vertical pin hole, thereby locking said horizontal blocking bar to said vertical blocking bar.

7. The blocking device of claim 1, wherein said mounting member comprises front and back clamping plates, and said plates are shaped to receive said rotating member.

8. The blocking device of claim 7, wherein said front and back clamping plates comprise an interior side, and wherein said interior side of said front and back clamping plates are one of slotted, curved, and grooved.

9. The blocking device of claim 1, further comprising a drill bushing mounted through the rotating member and a set screw attached to said drill bushing through said mounting member.

10. A switch blocking device for attachment to a rotating member to block axial rotation of such rotating member by striking an obstacle and thereby prevent operation of a switch, said switch blocking device comprising:

(a) a clamping member attachable to said rotating member;

(b) a horizontal member rigidly attached to said clamping member and extending outwardly from said clamping member to a distance at least as great as a horizontal distance between said rotating member and the obstacle;

(c) a vertical member attachable to said horizontal member at one or more points along the length of said horizontal member and extending at least one of upwardly and downwardly from said horizontal member to a distance at least as great as a vertical distance between said horizontal member and the obstacle.

11. The blocking device of claim 10, wherein said horizontal member comprises a plurality of horizontal member pin holes, and said vertical member comprises a vertical member pin hole, and further comprising a pin sized to fit snugly within said horizontal member pin holes and said vertical member pin hole.

12. The blocking device of claim 11, wherein said clamping member comprises front and back clamping plates, and said plates are shaped to receive the switch.

13. The blocking device of claim 12, wherein said front and black clamping plates comprise an interior side, and wherein said interior side of said front and back clamping plates are one of slotted, curved, and grooved.

14. The blocking device of claim 10, further comprising a set screw attached through said clamping member to the switch.

15. A blocking device for a switch, said switch in communication with an axially rotating member and adjacent to an obstacle, and said blocking device comprising:

(a) a plurality of clamping plates, wherein said clamping plates are each fitted to an opposite side of the rotating member, and said clamping plates are one of slotted, curved, and grooved to fit securely onto said rotating member; and (b) a horizontal member extending outwardly from one of said clamping plates, wherein rotation of said rotating member causes radial motion of said horizontal member and limits further rotation of said rotational member past the obstacle.

16. The blocking device of claim 15, further comprising a vertical member attachable to said horizontal member at a plurality of points along said horizontal member and wherein rotation of said rotating member causes radial motion of said vertical member whereby one of said vertical and said horizontal member strikes the obstacle and blocks further rotation of said rotational member past the obstacle.

17. The blocking device of claim 16, wherein said vertical member comprises clamping means by which to attach said vertical member to said horizontal member.

18. The blocking device of claim 16, wherein said horizontal member further comprises a plurality of horizontal member attachment points.

19. The blocking device of claim 16, wherein said horizontal member comprises a plurality of horizontal member pin holes, said vertical member comprises a vertical member pin hole, and further comprising a pin passing through one of said horizontal member pin holes and said vertical member pin hole.

20. The blocking device of claim 15, further comprising a drill bushing mounted through the rotating member and a set screw attached to said drill bushing through one of said mounting plates.

* * * * *

UNITED STATES PATENT AND TRADEMARK OFFICE

CERTIFICATE OF CORRECTION

PATENT NO. : 7,126,067 B2
APPLICATION NO. : 10/964125
DATED : October 24, 2006
INVENTOR(S) : Carl F. Culicchia, Jr. and Danny Madjzoob Hoss It is certified that error appears in the above-identified patent and that said Letters Patent is hereby corrected as shown below:

Title Page item 73
The assignee should read -- Entergy Services, Inc. --.

Signed and Sealed this

Twenty-seventh Day of November, 2007

JON W. DUDAS
*Director of the United States Patent and Trademark Office*